US006698702B2

(12) United States Patent
Macri et al.

(10) Patent No.: US 6,698,702 B2
(45) Date of Patent: Mar. 2, 2004

(54) ROOFING BRACKET

(76) Inventors: Joseph P. Macri, 307 Matthew St., Rome, NY (US) 13440; Frank Mellace, 102 W. Cedar St., Rome, NY (US) 13440

( * ) Notice: Subject to any disclaimer, the term of this patent is extended or adjusted under 35 U.S.C. 154(b) by 0 days.

(21) Appl. No.: 10/223,715

(22) Filed: Aug. 20, 2002

(65) Prior Publication Data

US 2002/0195532 A1 Dec. 26, 2002

Related U.S. Application Data

(63) Continuation-in-part of application No. 09/783,166, filed on Feb. 15, 2001, now abandoned, which is a continuation-in-part of application No. 10/120,873, filed on Apr. 11, 2002.

(51) Int. Cl.[7] ..... A47G 29/02; E04G 3/12

(52) U.S. Cl. ..... 248/237; 182/45

(58) Field of Search ..... 248/237, 148, 248/536; 182/45 R, 117; 52/24

(56) References Cited

U.S. PATENT DOCUMENTS

| | | | | | |
|---|---|---|---|---|---|
| 185,137 | A | * | 12/1876 | Rogers | 52/24 |
| 1,159,372 | A | * | 11/1915 | Goff | 248/237 |
| 1,172,227 | A | * | 2/1916 | Schade | 248/237 |
| 1,241,335 | A | * | 9/1917 | Boyd | 248/237 |
| 1,255,692 | A | * | 2/1918 | Bearden | 248/237 |
| 1,495,868 | A | * | 5/1924 | Nielsen | 248/237 |
| 1,562,965 | A | * | 11/1925 | Hubschmitt, Jr. | 248/237 |
| 1,592,384 | A | * | 7/1926 | Peck | 248/237 |
| 1,599,209 | A | * | 9/1926 | Cashman | 248/237 |
| 1,639,352 | A | * | 8/1927 | Schade | 248/237 |
| 1,646,923 | A | * | 10/1927 | Martens | 248/237 |
| 1,886,921 | A | * | 11/1932 | Tobin | 182/117 |
| 4,856,745 | A | * | 8/1989 | Mabie | 248/237 |
| 4,884,775 | A | * | 12/1989 | Fischer, Jr. | 248/237 |
| 4,946,123 | A | * | 8/1990 | Albert | 248/237 |
| 5,113,971 | A | * | 5/1992 | Violet | 182/45 |
| 5,669,184 | A | * | 9/1997 | Anderson | 52/26 |
| 5,732,918 | A | * | 3/1998 | Steele et al. | 248/237 |
| 5,979,600 | A | * | 11/1999 | Bitner | 182/45 |

FOREIGN PATENT DOCUMENTS

DE 3541112 A1 * 5/1987

* cited by examiner

*Primary Examiner*—Anita King
(74) *Attorney, Agent, or Firm*—David Giglio

(57) ABSTRACT

A roofing bracket for use with a platform for working on a roof. The roofing bracket includes a base having a proximal and distal end. At least one nail slot is disposed through the base near its distal end. A platform support arm disposed along the base includes a bottom lip, a platform support and a guardrail. A backside support extends from the proximal end of the base. The backside support includes an angled lip that is attached with a rear portion of the platform support. A heel extends from the backside support. Finally, at least one brace is disposed between the backside support and the platform support. The heel and brace cooperate to provide a roofer with easy means in which to remove the bracket after use, such that the bracket nor roofing shingles are destroyed.

35 Claims, 16 Drawing Sheets

ROOFING BRACKET

This is a second continuation in part application from previous application Ser. No. 09/783,166 filed on Feb. 15, 2001 ABN. The first continuation in part application Ser. No. 10/120,873 was filed on Apr. 11, 2002.

BACKGROUND OF THE INVENTION

1. Technical Field

The present invention relates generally to an apparatus for assisting a roofer performing work on a roof, and, more particularly to an apparatus which is secured to a roof and supports a platform so that the roofer can work off of the platform.

2. Background Art

Roofing brackets are well known in the art of roofing. Shown in FIG. 1 is a roofing bracket 10 of the prior art. The roofing bracket 10 used in conjunction with a platform allows a roofer to gain access to higher positions on a roof. In use, a roofer lifts a portion of an upper shingle and places the roofing bracket 10 over a tar saturated portion of a lower shingle. The roofer drives a nail into each nail slot disposed through the roofing bracket. Typical roofing brackets include three nail slots.

Once the roofing bracket 10 is secure in place, the roofer inserts a platform into a platform support arm 24 between at least two roofing brackets. At this point, the roofer uses the platform as support and to hold tools and supplies.

When the roofer finishes his work, he must remove the roofing bracket 10. One method for removing the roofing bracket 10 is to pry the bracket 10 out at the nailed slotted portions. However, this proves difficult and often destroys parts of the upper shingle. Further, the nails are very difficult to pry from several types of wood used on roofs, such as tongue and groove pieces.

Another method more commonly used is to strike a backside support 42 of the roofing bracket 10 with a hammer, so that the bracket 10 will slide along the nails at slotted channels until the roofing bracket 10 becomes disengaged. However, this is difficult because the backside support 42 of the roofing bracket 10 often collapses, thus destroying the bracket 10.

OBJECTS AND SUMMARY OF THE INVENTION

It is therefore an object of the present invention to overcome the problems associated with the prior art, as discussed above, and to provide an improved roofing bracket.

It is another object of the present invention to provide a roofing bracket that is easily removed from the roof when finished in use.

It is a further object of the present invention to provide a roofing bracket that stays intact during its removal from the roof.

It is yet another object of the present invention to provide a roofing bracket that can be removed without destroying any installed shingles.

It is yet a further object of the present invention to provide a roofing bracket that is durable so that it can be reused time and time again.

It is still another object of the present invention to provide a roofing bracket that can be manufactured in a simple manner.

It is still a further object of the present invention to provide a roofing bracket such that the backside support does not collapse when struck with a hammer.

These and other objects are attained in accordance with the present invention wherein there is provided a roofing bracket for use with a platform and having a base with a proximal and distal end. At least one nail slot is disposed through the base near its distal end. A platform support arm is disposed along said base and includes a bottom lip, a platform support and a guardrail. A backside support perpendicularly extends from the proximal end of the base. The backside support includes an angled lip, wherein the angled lip is attached with a rear portion of the platform support. A heel extends from the backside support. Finally, at least one brace is disposed between the backside support and the platform support.

In various embodiments, the heel is of a different color than the color of the backside support. The heel may be disc-shaped and include a thickness that is greater than the thickness of the backside support. The disc-shaped heel includes a diameter that is equal to the width of the backside support. In a preferred embodiment, the heel is rectangular shaped having a width equal to a width of the backside support.

The at least one angle brace is preferably partially rectangular shaped having one side being wedge or triangular shaped and extends from the front side of the backside support to the back side of the platform support. The triangular or wedge shaped portion has dimensions formed by the interior angle between the platform support arm and the base. Various other sizes and shapes can also make an effective angle brace.

The roofing bracket of the present invention can be one-piece cast or manufactured from a plurality of components.

BRIEF DESCRIPTION OF THE DRAWINGS

Further objects of the present invention will become apparent from the following description of the preferred embodiments with reference to the accompanying drawings, in which.

DETAILED DESCRIPTION OF A PREFERRED EMBODIMENT OF THE PRESENT INVENTION

Figure 1:
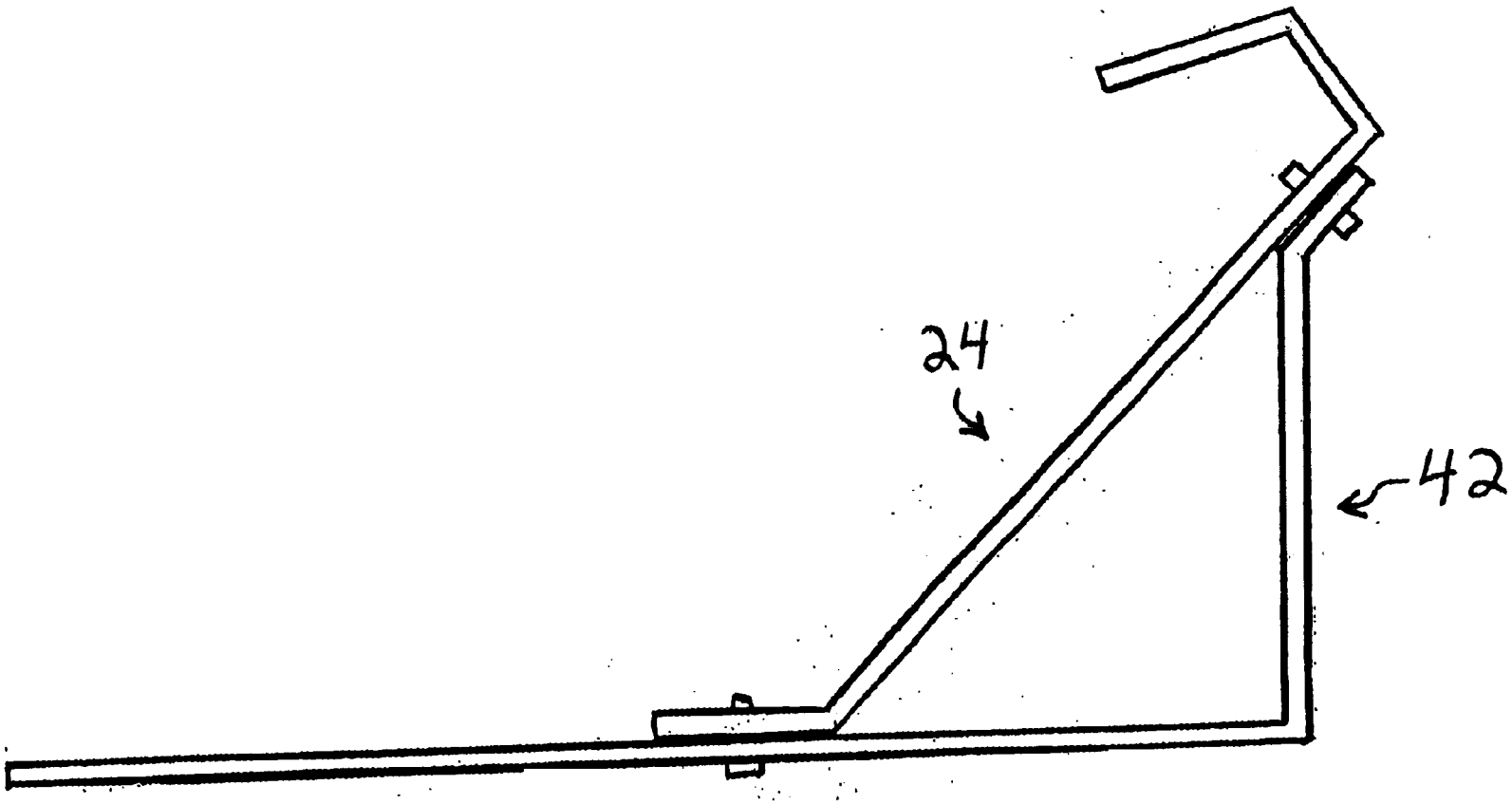
FIG. 1 PRIOR ART
FIG. 1 is a side-elevation view of the roofing bracket of the prior art.
Figure 2:
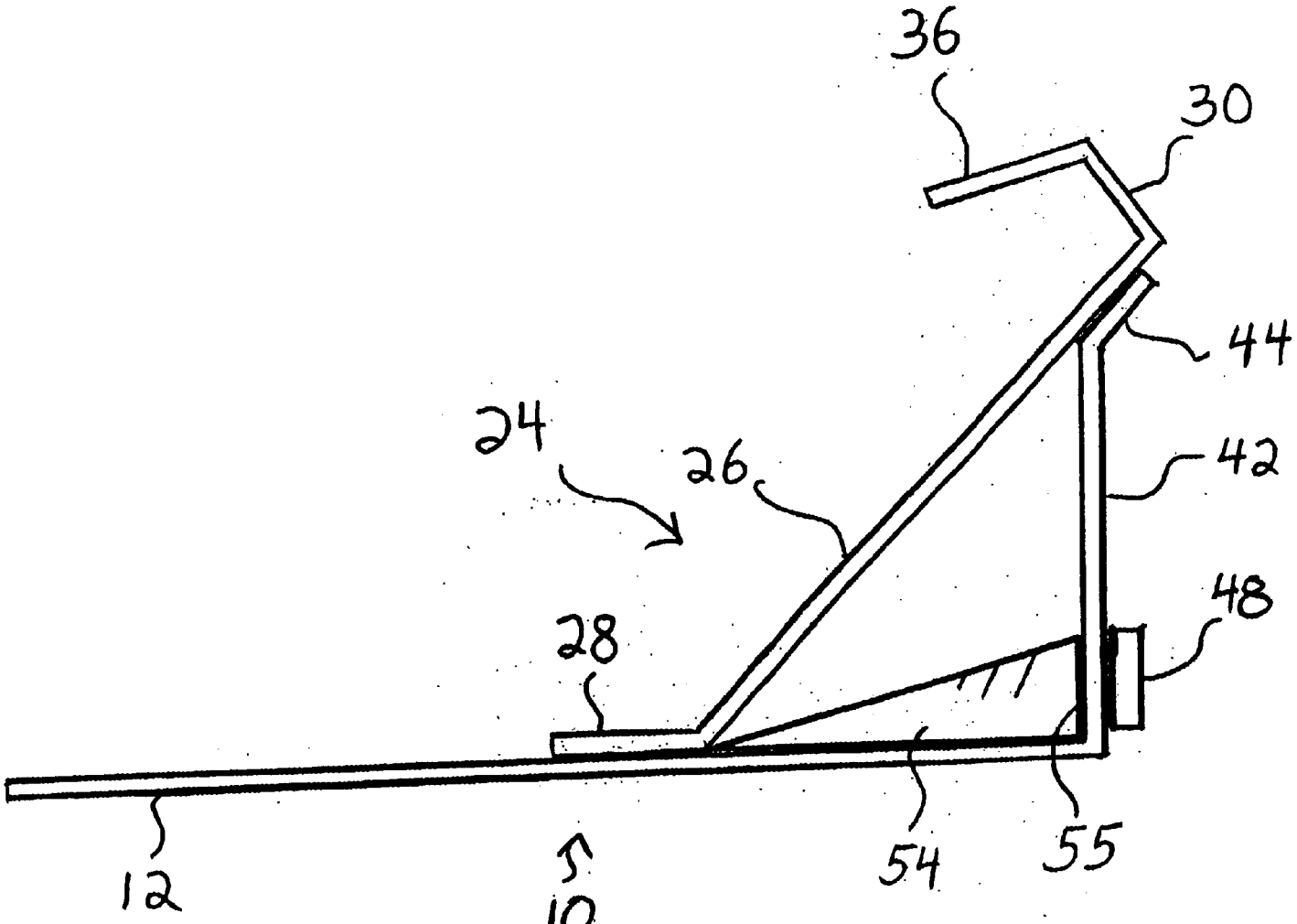
FIG. 2 is a side-elevation view of the roofing bracket of the present invention.
Figure 3:
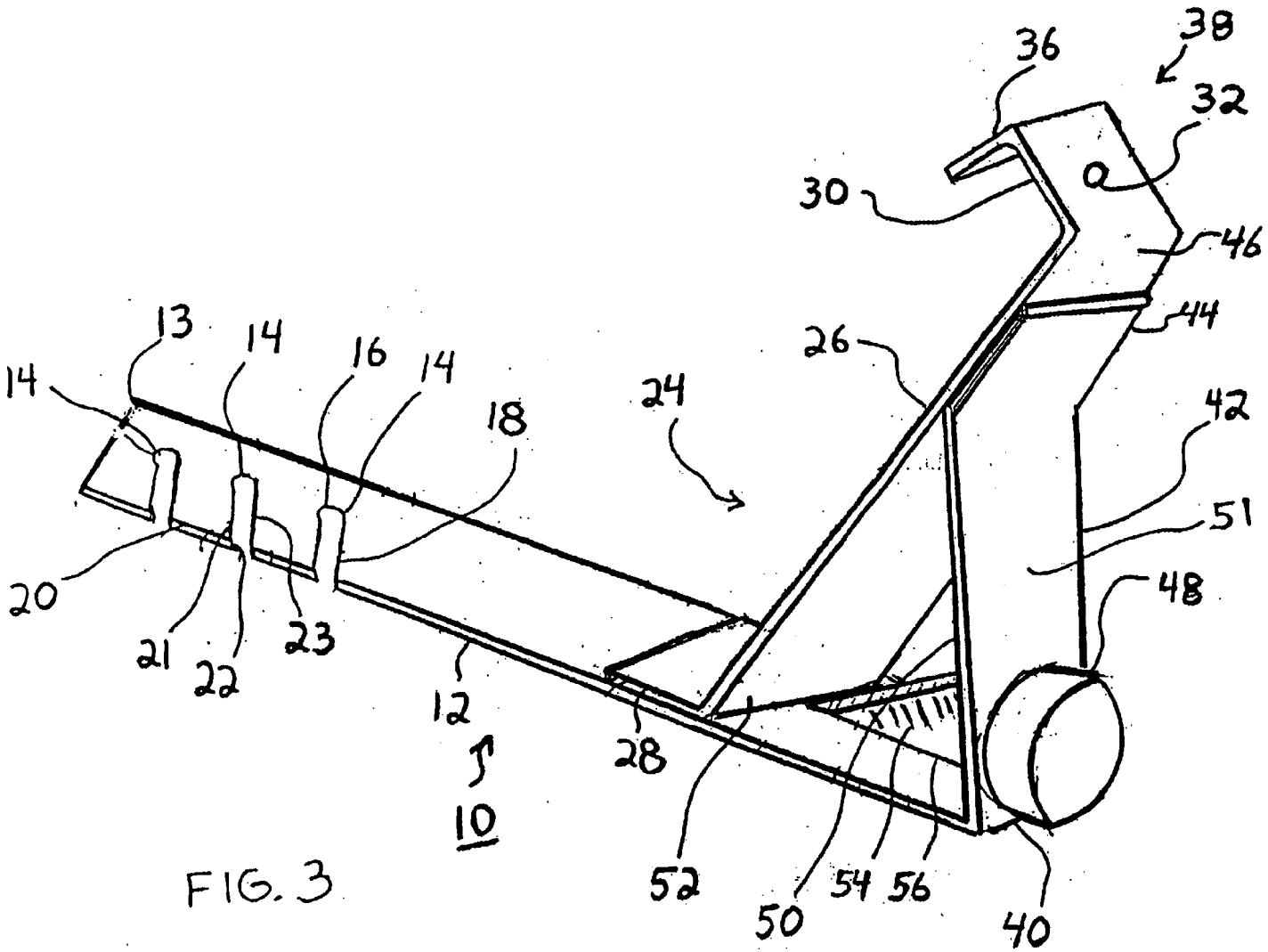
FIG. 3 is a perspective view of the roofing bracket of FIG. 2.
Figure 11:
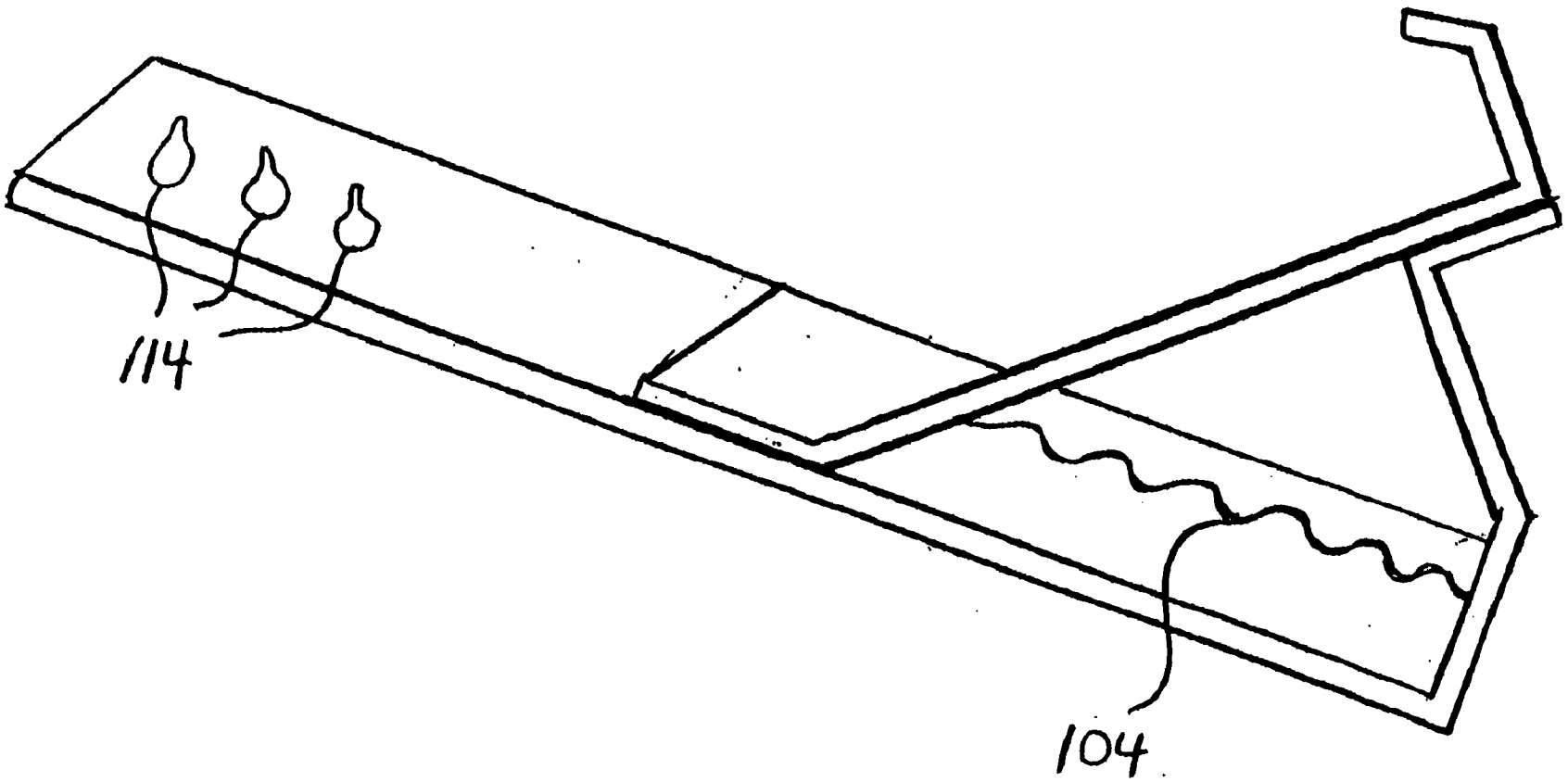
FIG. 11 is a perspective view of a roofing bracket in accordance with yet another alternative embodiment having a corrugated brace.

Referring now to FIGS. 2–3, the roofing bracket 10 of the present invention shall be described in detail. The roofing bracket 10 includes a flat bottomed base 12 having a plurality of nail slots 14 disposed therethrough. The nail slots 14 include an arcuate head portion 16 which opens into a rearwardly running slanted channel 18. Alternatively the nail slots could be teardrop shaped nail slots 114 as shown in FIG. 11 or any other slot known would be obvious to one skilled in the art. Turning back now to FIG. 3, the slanted channel 18 runs continuously until a lateral edge 20 of the base 12 is reached. At the lateral edge 20, the distal edge 22 of the slanted channel 18 bevels rearwardly.

Moving rearwardly along the base 12, a platform support arm 24 includes a platform support 26 and a bottom lip 28, wherein the bottom lip 28 mounts to the base 12. It is desirable that the angle of the platform support 26 relative to the base 12 matches the pitch of the roof.

Moving upward along the platform support arm 24, a top support member 30 disposed on the upward edge of the platform support 26 runs substantially perpendicular to the platform support 26. The top support member 30 includes an opening 32 that allows a nail 74 to be driven therethrough and into a platform 34 (shown in FIG. 4). This nail prevents the platform 34 from moving in any direction.

At the upward edge of the top support member 30, a platform flange cover 36 is disposed in a downward angled forward facing direction. The top support member 30 and platform flange cover 36 form a substantially L-shaped guardrail 38 having an angle that is slightly greater than ninety degrees. The L-shaped guardrail 38 prevents the platform 34 from moving upward or forward. By having the angle of the L-shaped guardrail 38 greater than ninety degrees, it becomes easier to install and remove the platform 34 from the roofing bracket 10. It should be apparent to one skilled in the art that other shaped guardrails can be equally effective.

Once again moving rearward along the base 12 and to its proximal end 40, a backside support 42 is disposed upwardly and perpendicular from the proximal end 40 of the base 12. The backside support 42 includes an angled lip 44 that mounts to the rear side 46 of the platform support 26 and aligned in the same direction as the platform support 26. The mounting means for the angled lip 44 of the backside support 42 to the platform support 26 and the mounting means for the platform support arm bottom lip 28 to the base 12 will be discussed later.

Figure 10:
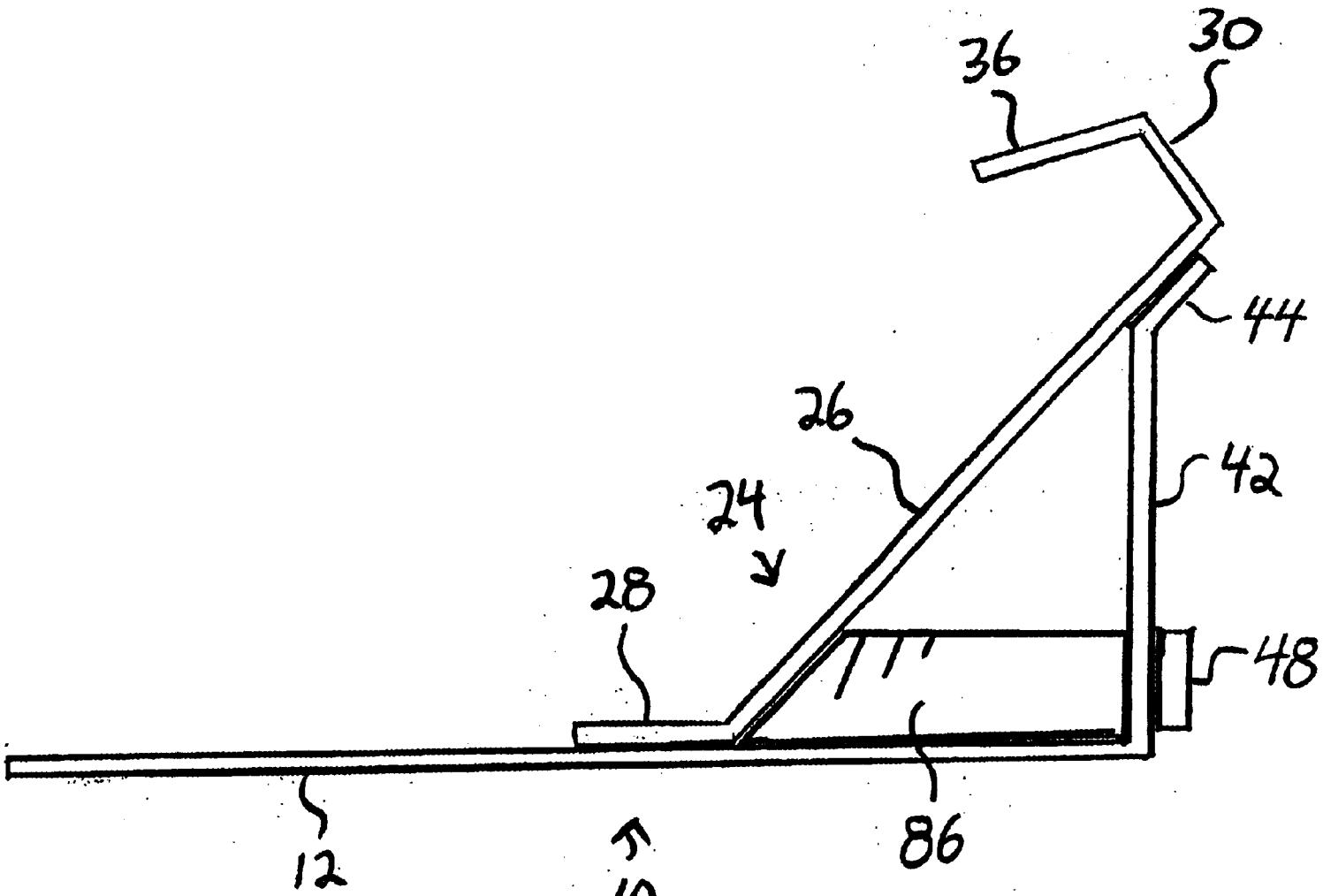
FIG. 10 is a side elevation view of the roofing bracket shown in FIG. 5 minus the heel.

A heel 48 extends from the lower back side 51 of the backside support 42. In a preferred embodiment, the heel 48 is rectangular-shaped having a uniform thickness. It is preferred, but not necessary, that the lateral dimensions of the heel 48 be roughly equivalent to the width of the backside support 42. It is preferable but not necessary that the thickness of the heel 48 be greater than the thickness of the backside support 42. In a preferred embodiment, the thickness of the backside support 42 is approximately one eighth inch, while the thickness of the disc-shaped heel 48 is slightly greater than three eighths inch. It is also possible to create the roofing bracket 10 not having the heel 48 as shown in FIG. 10.

While this invention is described according to a preferred embodiment, it is not necessary that the heel 48 be rectangular. Other heel shapes will suffice.

Looking now between the front side 50 of the backside support 42 and the bottom rear side 52 of the platform support 24, there is disposed a triangular shaped brace 54. The bottom surface 56 of the brace 54 mounts longitudinally along the center of the base 12. A rear end 55 of the brace 54 mounts longitudinally to the front side 50 of the backside support 42. In a preferred embodiment, the height of the rear end 55 of the brace 54 is roughly equivalent to the diameter of the disc-shaped heel 48. Although the shape of the brace 54 has been described as being triangular shaped, it should be apparent to one skilled in the art that other brace shapes can also be effective, or that a plurality of angle braces can also be utilized.

Figure 5:
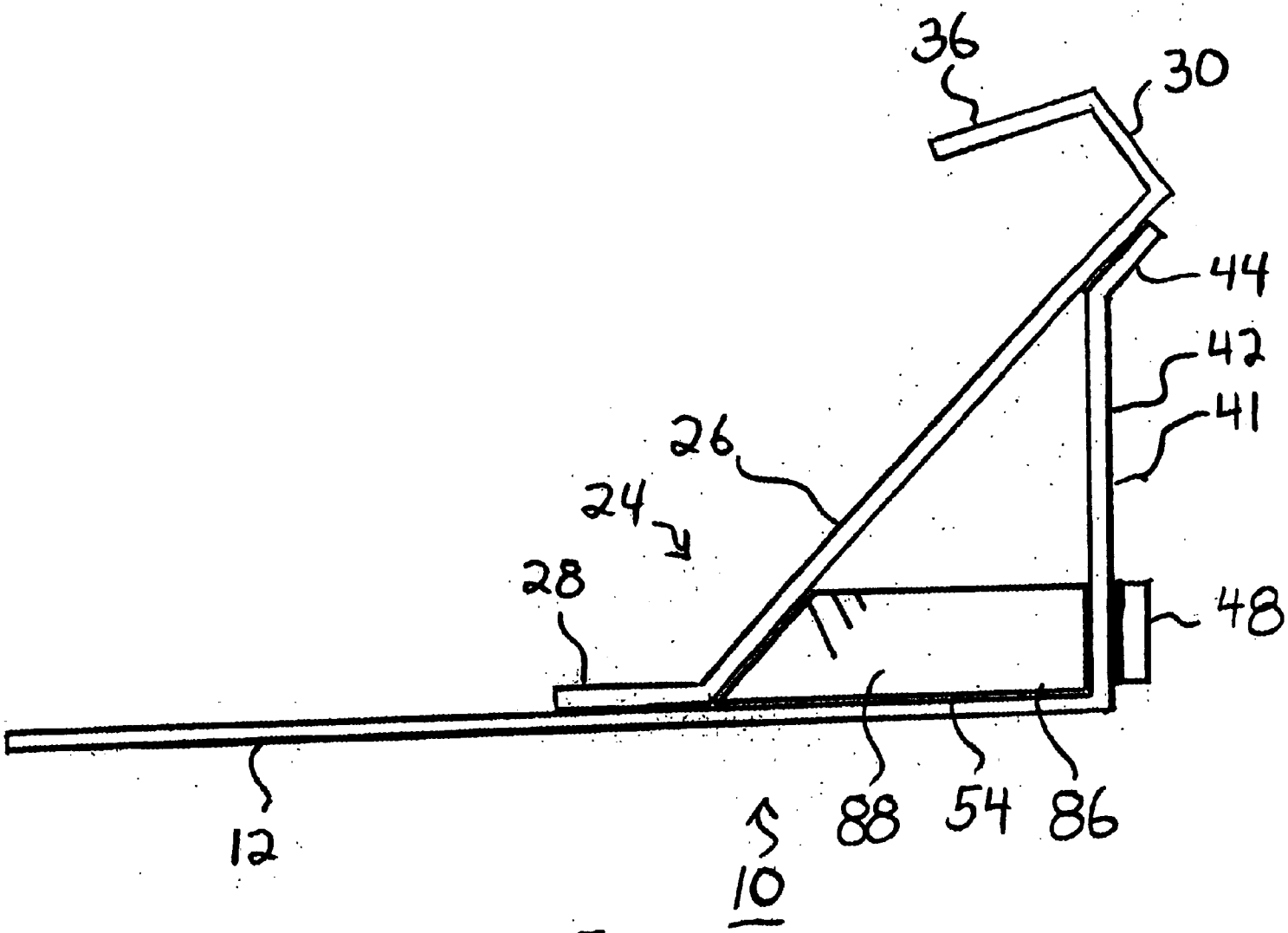
FIG. 5 is a side elevation view of the roofing bracket in accordance with a preferred embodiment of the present invention.
Figure 6:
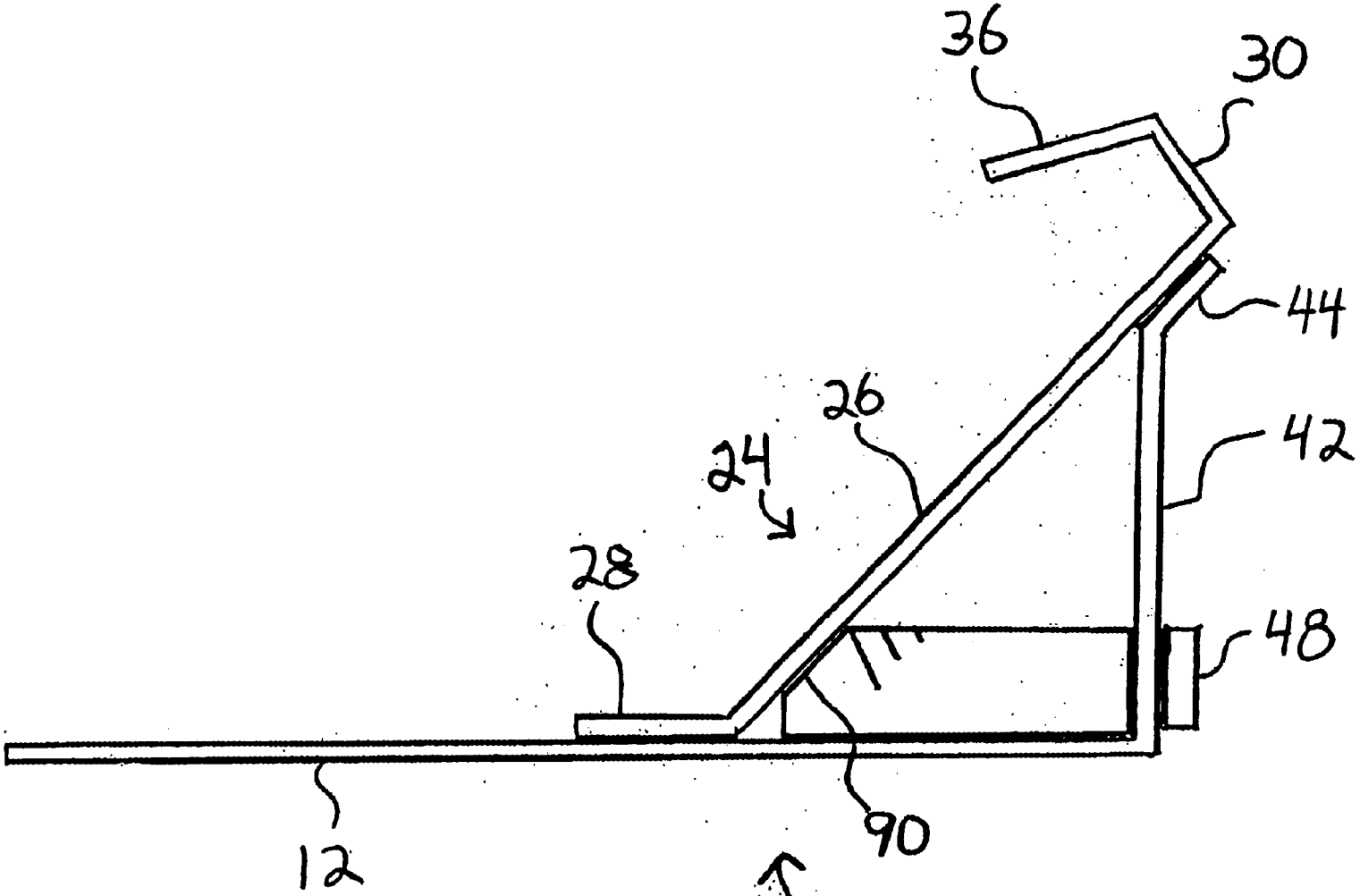
FIG. 6 is a side elevation view of the roofing bracket in accordance with an alternative embodiment of the present invention.

In FIGS. 5 and 6 and according to another preferred embodiment the brace 54 includes a substantially rectangular shaped portion 86 and a triangular shaped portion 88 or wedge shaped portion 90.

Figure 7:
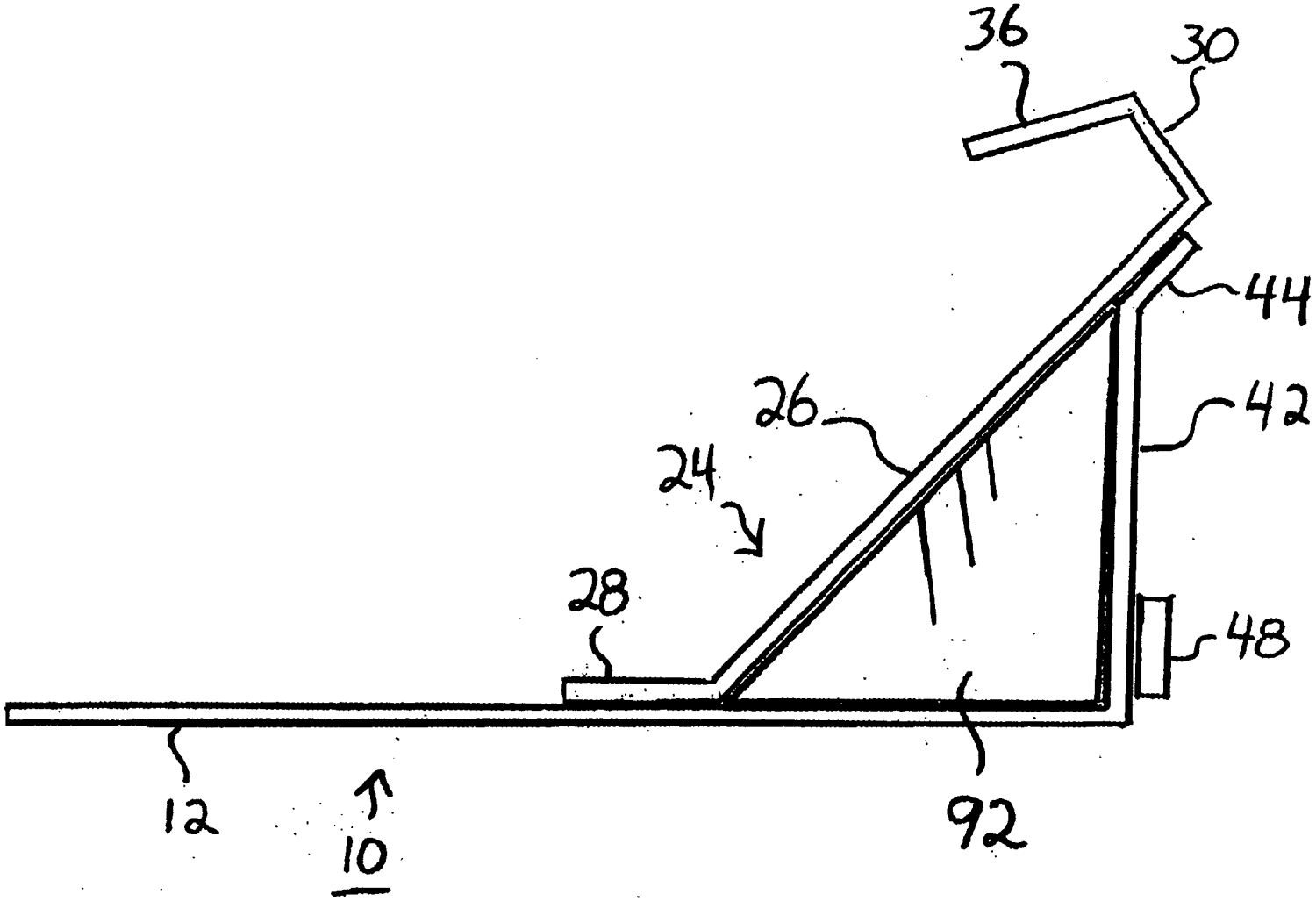
FIG. 7 is a side elevation view of the roofing bracket in accordance with a second alternative embodiment of the present invention.

In yet another alternative embodiment a triangular shaped brace 92 defines a cross sectional area of the triangular shaped volume formed by base 12, platform support 26 and the backside support 42, shown in FIG. 7.

Figure 8:
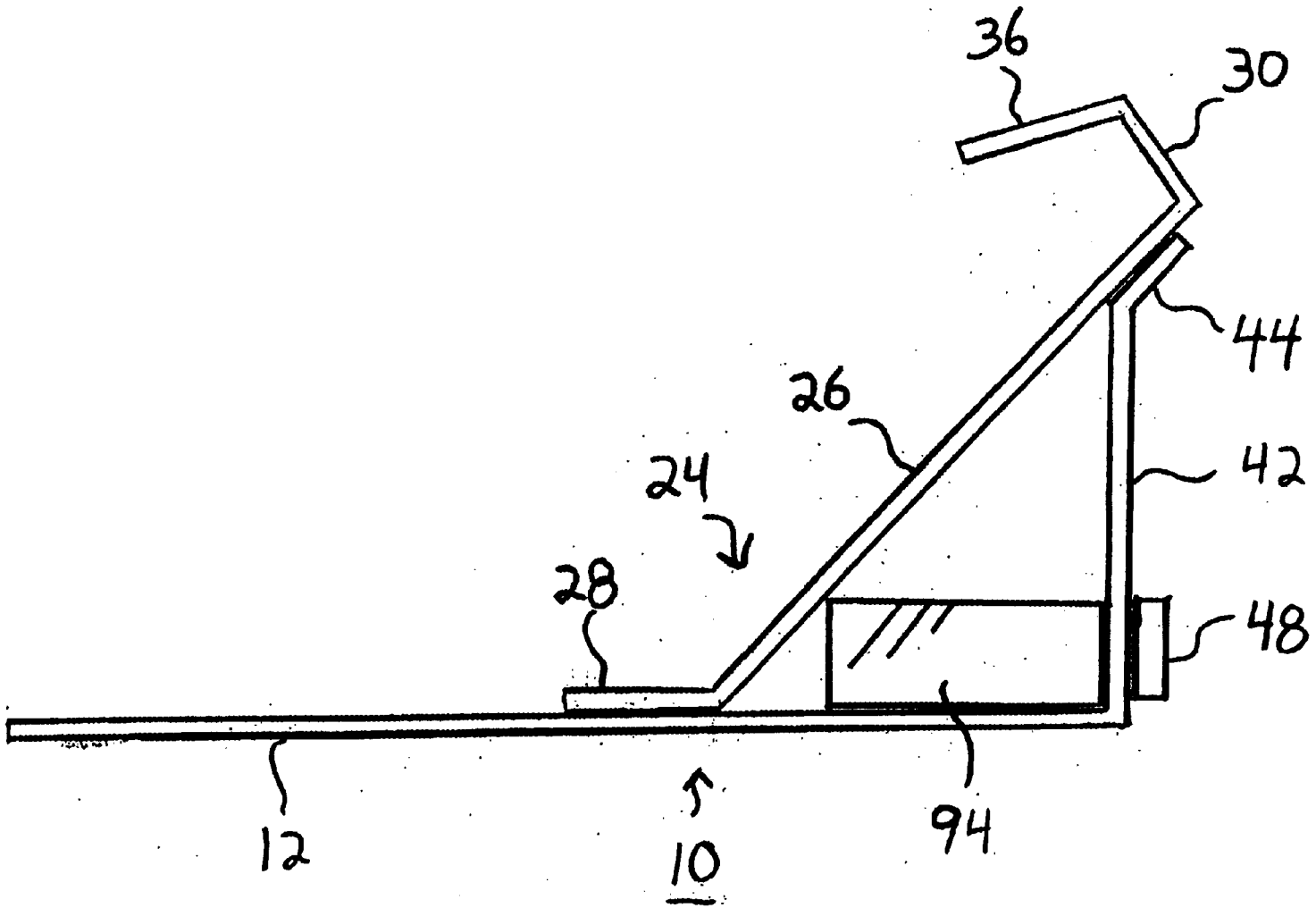
FIG. 8 is a side elevation view of the roofing bracket in accordance with a third alternative embodiment of the present invention.

In still yet another alternative embodiment a rectangular shaped brace 94 is disposed between the backside support 42 and the platform support 26, shown in FIG. 8.

Figure 9:
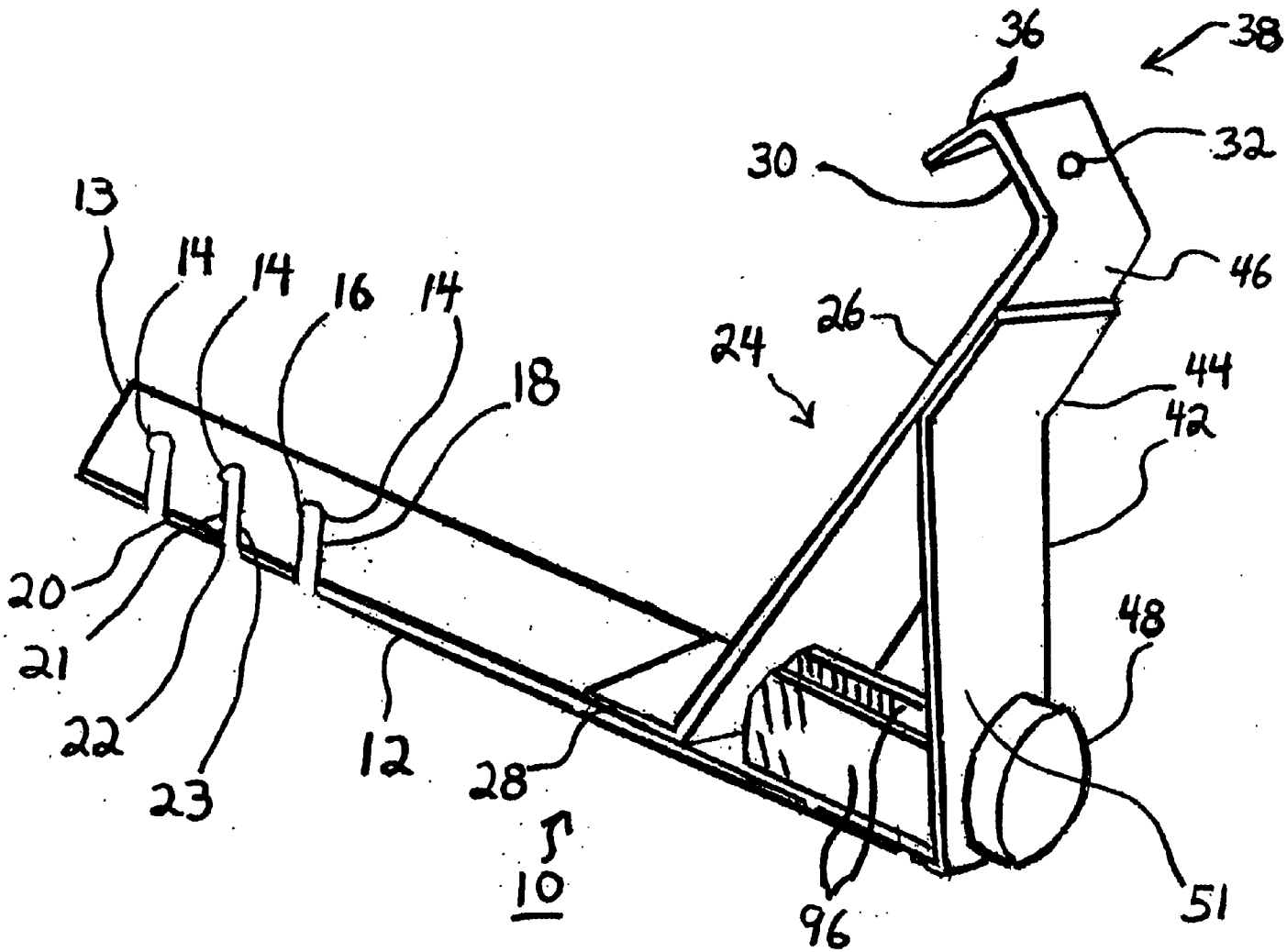
FIG. 9 is a perspective view of the roofing bracket in accordance with a fourth alternative embodiment of the present invention.

It is also possible to include a plurality of braces 96, FIG. 9, between the backside support 42 and the platform support 26.

Turning back to the mounting means between the platform support arm bottom lip 28 to the base 12 and backside support angle lip 44 to the platform support 26, it should be noted that typical mounting means are known in the art and include welding and/or riveting. It has been common in the art to rivet because the roofing brackets 10 are banged often with hammers, which destroys welded joints quicker than riveted joints.

With respect to the base 12, backside support 42, and angle lip 44, it is preferable to one piece die cast using an appropriate metal such as steel. The platform support arm 24 is also one piece die cast steel. Typically, a flat piece of steel having suitable dimensions is manipulated to shape to form the base 12, backside support 42, angled lip 44 and platform support arm 24 using known manipulation means. Finally, the heel 48 is one piece cast as is the brace 54. In fabricating the bracket, all four above identified pieces are welded and/or riveted together using means known in the art of fabrication.

Figure 4:
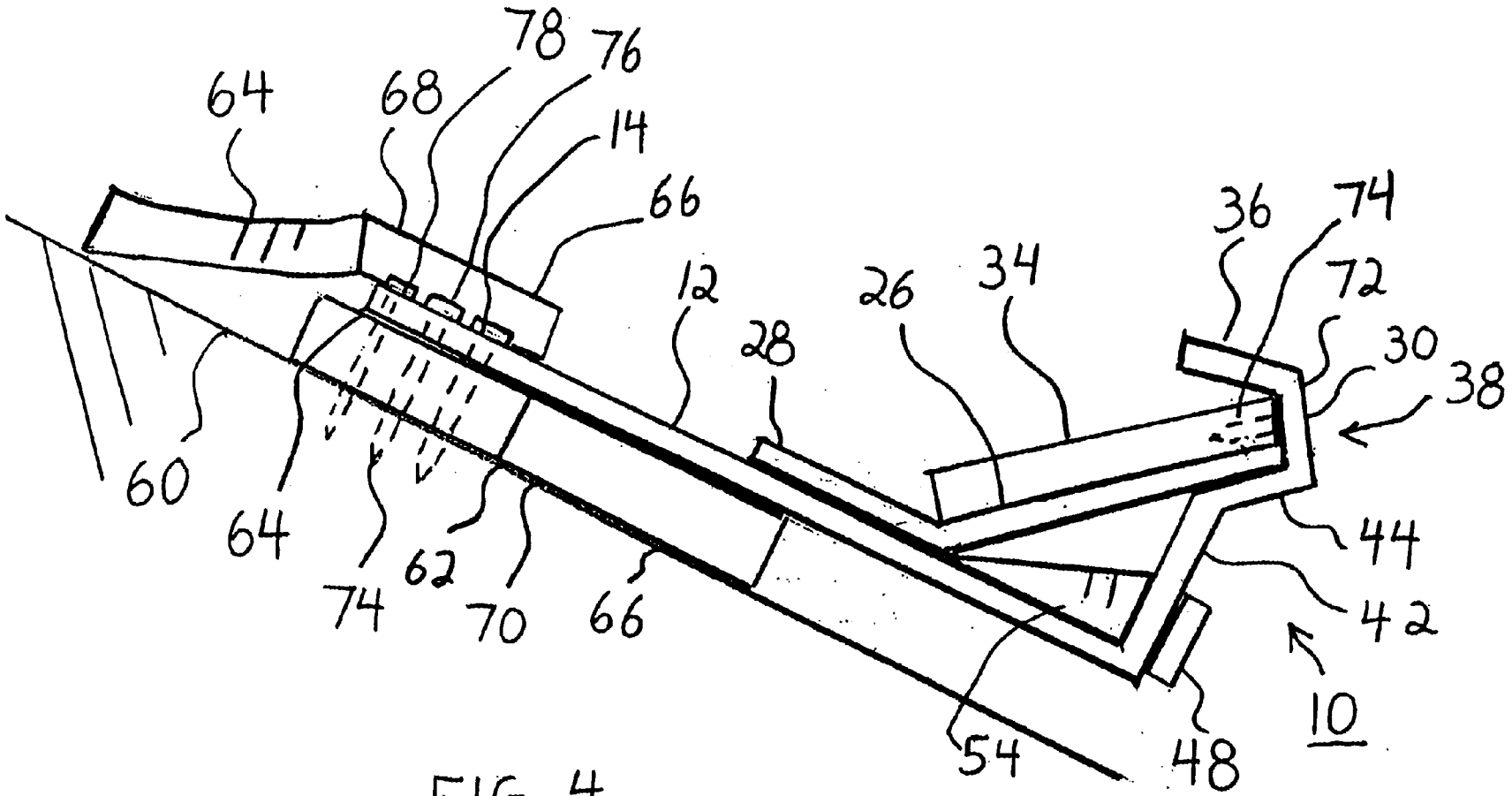
FIG. 4 is a side-elevation view of the roofing bracket of FIGS. 2 and 3 shown in use on a typical roof.

Turning now to FIG. 4, there is shown a roofing bracket 10 of the present invention in use on a roof 60. A roofing shingle 62 typically consists of a thick tar saturated material upper part 64 and a granular showy lower part 66. The granular showy lower part 66 of an upper shingle 68 conceals the thick tar saturated upper part 64 of a lower shingle 70. A roofer starts at the bottom of the roof and works his way up to the peak of the roof.

In order to gain access to a higher point on the roof, at least two roofing brackets are set apart a distance side by side. The platform, typically a 2×6, 2×8, 2×10 or 2×12 is securely placed onto the platform support arms 24 so that one side edge 72 of the platform fits snugly inside the L-shaped guardrail 38 of the roofing brackets 10. The roofer uses the platform 34 as a means of storing tools and materials and to support his body weight.

Prior to placing the platforms 34 onto the roofing brackets 10, the roofing brackets 10 must be set in place. The roofer peels back the granular showy lower part 66 of an upper shingle 68. The roofing bracket 10 is placed over the lower shingle 70 so that the plurality of nail slots 14 are disposed over the thick tar saturated upper part 64 of the lower shingle 70. The roofer drives a nail 74 through the arcuate head portion 16 of each nail slot 14 until the nail head 76 contacts the upper surface 78 of the roofing bracket base 12.

After using and removing the platform 34, the roofer removes the roofing bracket 10 by tapping sharply with a hammer head squarely onto the heel 48 of the roofing bracket 10. In a preferred embodiment, the heel 48 is of a different color than the color of the backside support 42 so as to provide the roofer with a more visible striking target.

As previously described, the nail slots 14 include an arcuate head portion 16 disposed along the central longitudinal axis of the base 12. The arcuate head portion 16 opens into a backwardly directed slanted channel 18 such that when the heel 48 is struck with the hammer, the base 12 is urged into the direction of its distal end 13 and away from the direction that the slanted channel 18 runs from the arcuate head portion 16. The slanted channels 18 run until they reach a beveled portion 22 on the distal side 21 of the slanted channel 18 at which point the beveled portion 22 and the proximal side 23 of the slanted channel 18 open at a lateral edge 20 of the base 12.

The brace 54 extends between the front side 50 of the backside support 42 to the lower rear side 52 of the platform support 26. As the hammer strikes the heel 48, the brace 54 serves several functions. First, the brace 54 causes the force of the strike to transfer substantially longitudinally along the base 12, thereby causing the base 12 to shift uniformly forward.

Second the brace 54 acts to prevent the backside support 42 from collapsing as the heel 48 is struck with the hammer head.

As the force of the hammer causes the base 12 to shift in a forward direction, the slanted channels 18 of the nail slots 14 ride along a side edge of their respective nails 74 until the nail slots 14 become completely disengaged from the nails 74. At this point, the roofer completely removes the roofing bracket 10 and pounds the nails 74 into the thick tar saturated part 64 of the under shingle 70.

According to yet another alternative embodiment shown in FIG. 11, the base 12 includes a portion between the platform support 26 and the backside support 42 having a corrugated ridge 104 along its longitudinal axis. The corrugated ridge 104 is made by stamping during manufacture of the bracket 10.

Figure 12:
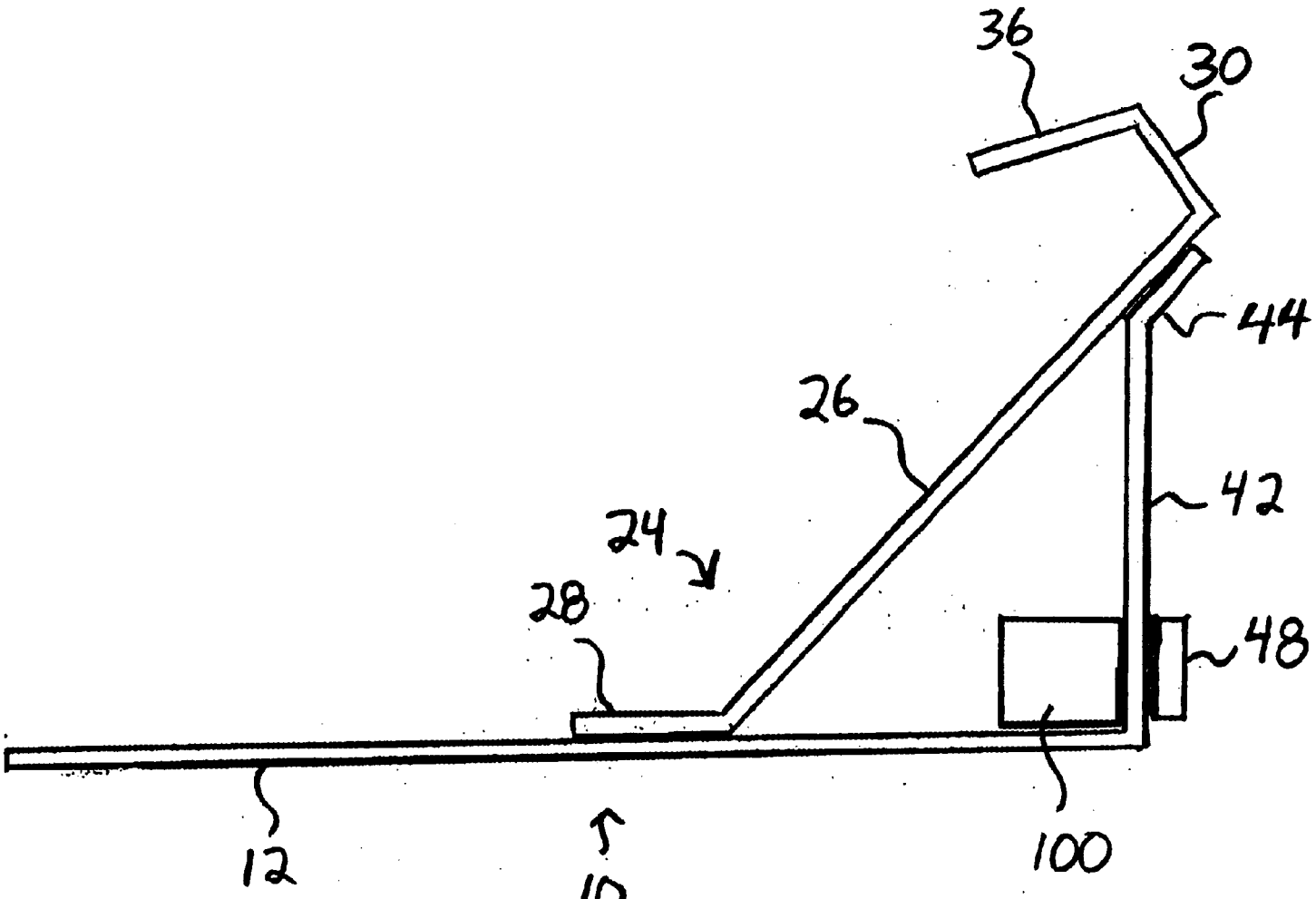
FIG. 12 is a side elevation view of a roofing bracket having a rectangular shaped brace.

In still yet another embodiment depicted in FIG. 12, the brace 100 extends only a portion along the base 12 from the backside support 42.

Figure 13:
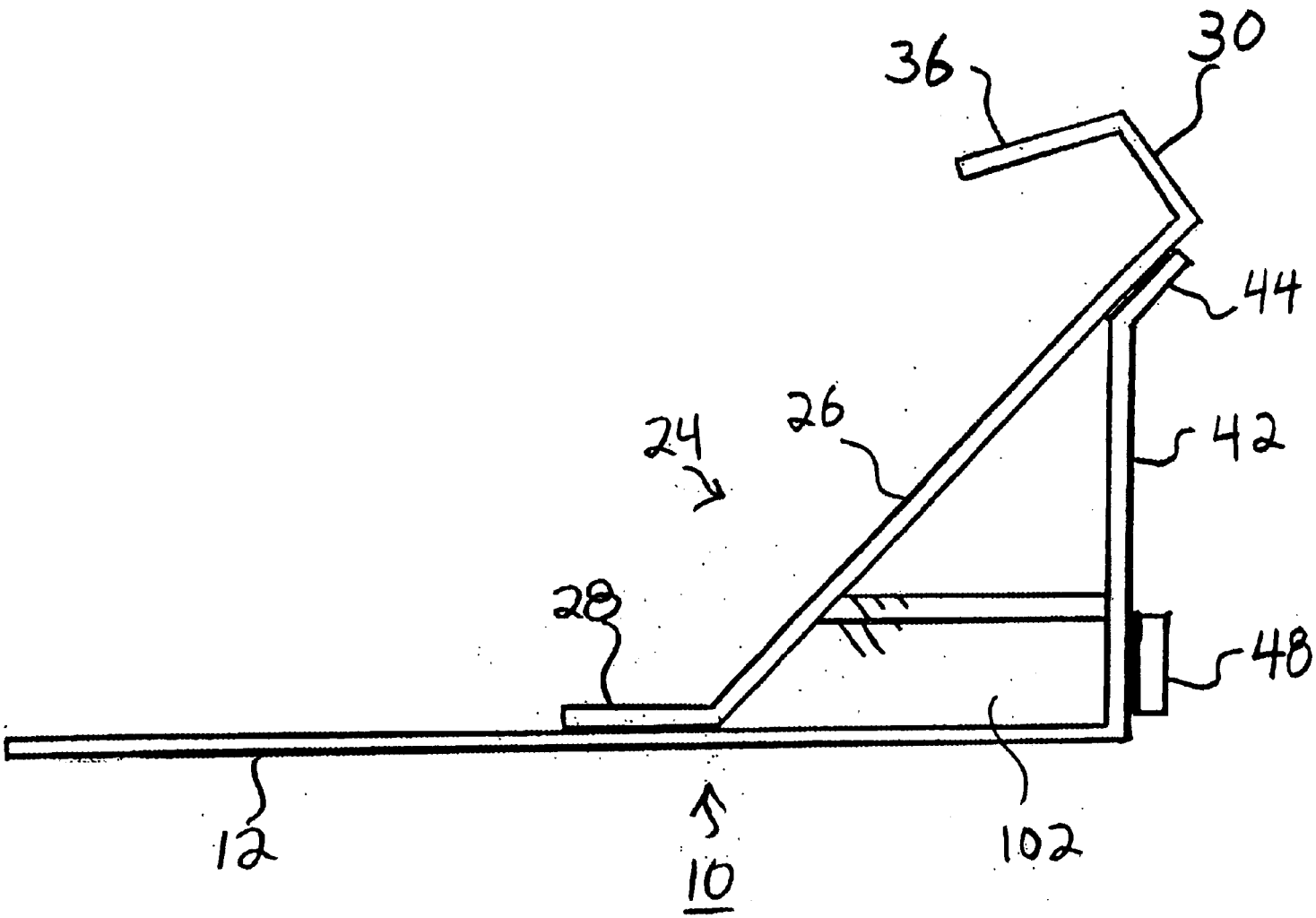
FIG. 13 is a side elevation view of a roofing bracket having an elevated brace.

In still yet another embodiment shown in FIG. 13, a raised brace 102 extends from the backside support 42 to the platform support 26.

Figure 14:
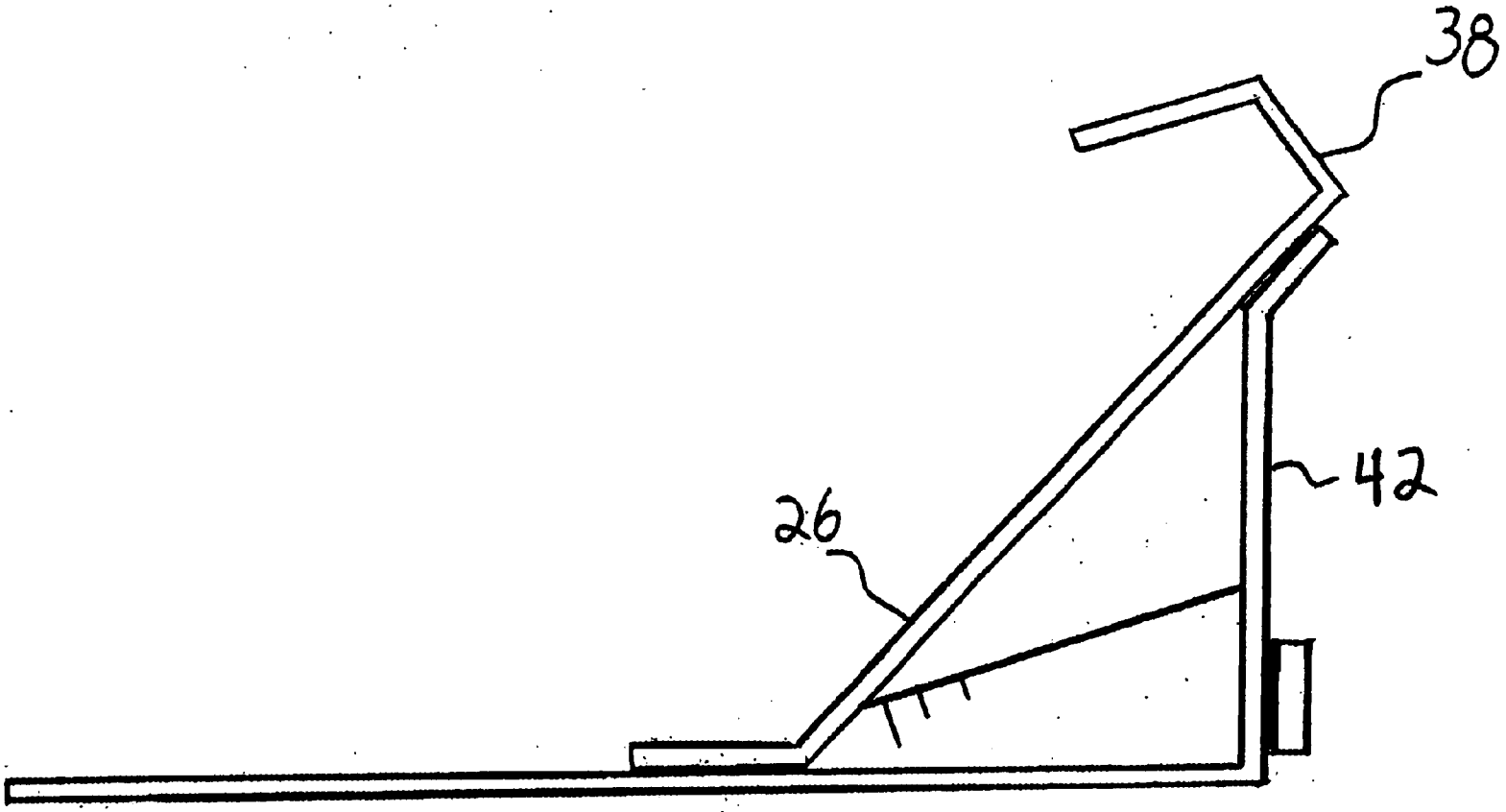
FIG. 14 is a side elevation view of a roofing bracket wherein the guardrail extends directly from the backside support.
Figure 15:
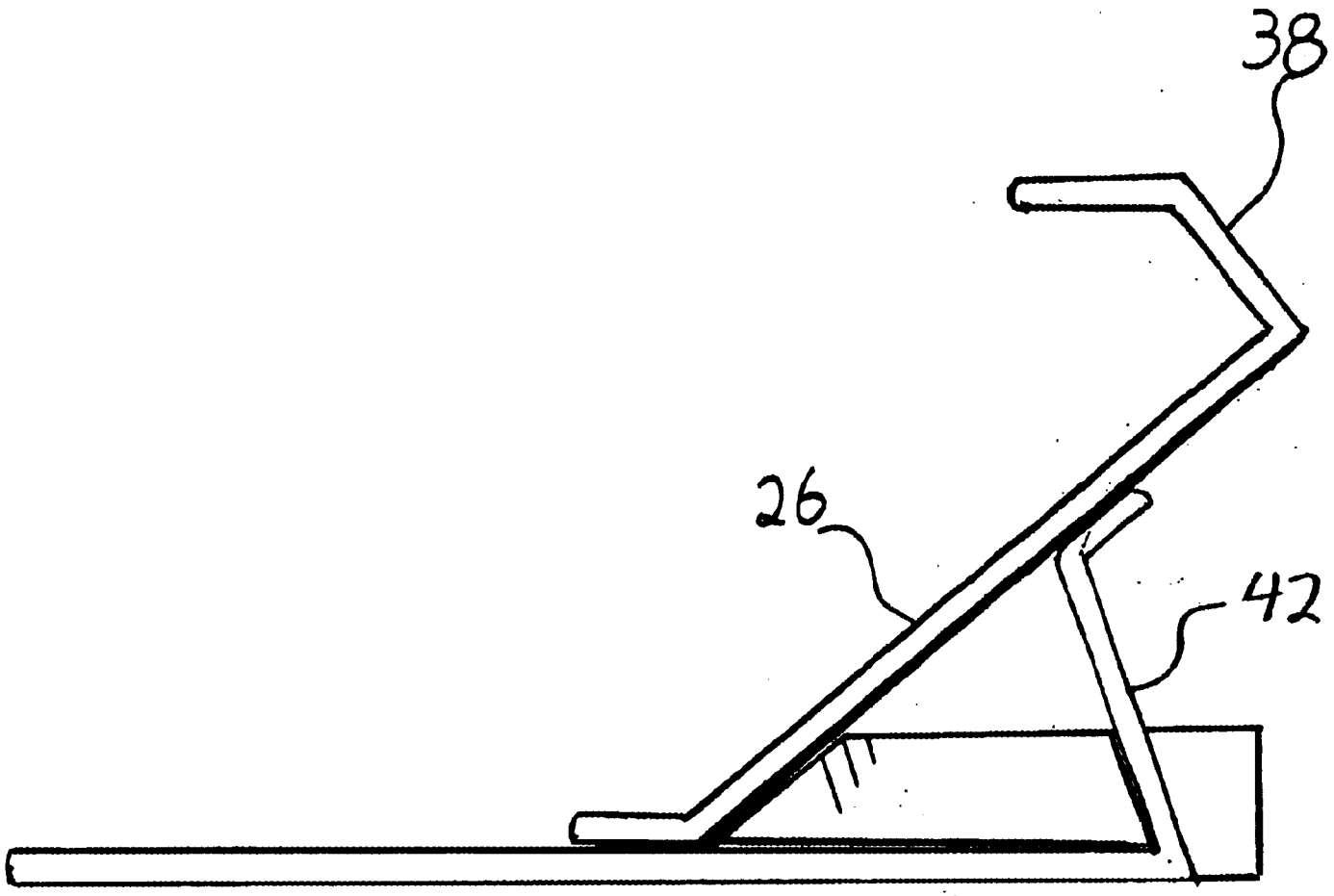
FIG. 15 is a side elevation view of a roofing bracket wherein the backside support angles inward directly from the base.
Figure 16:
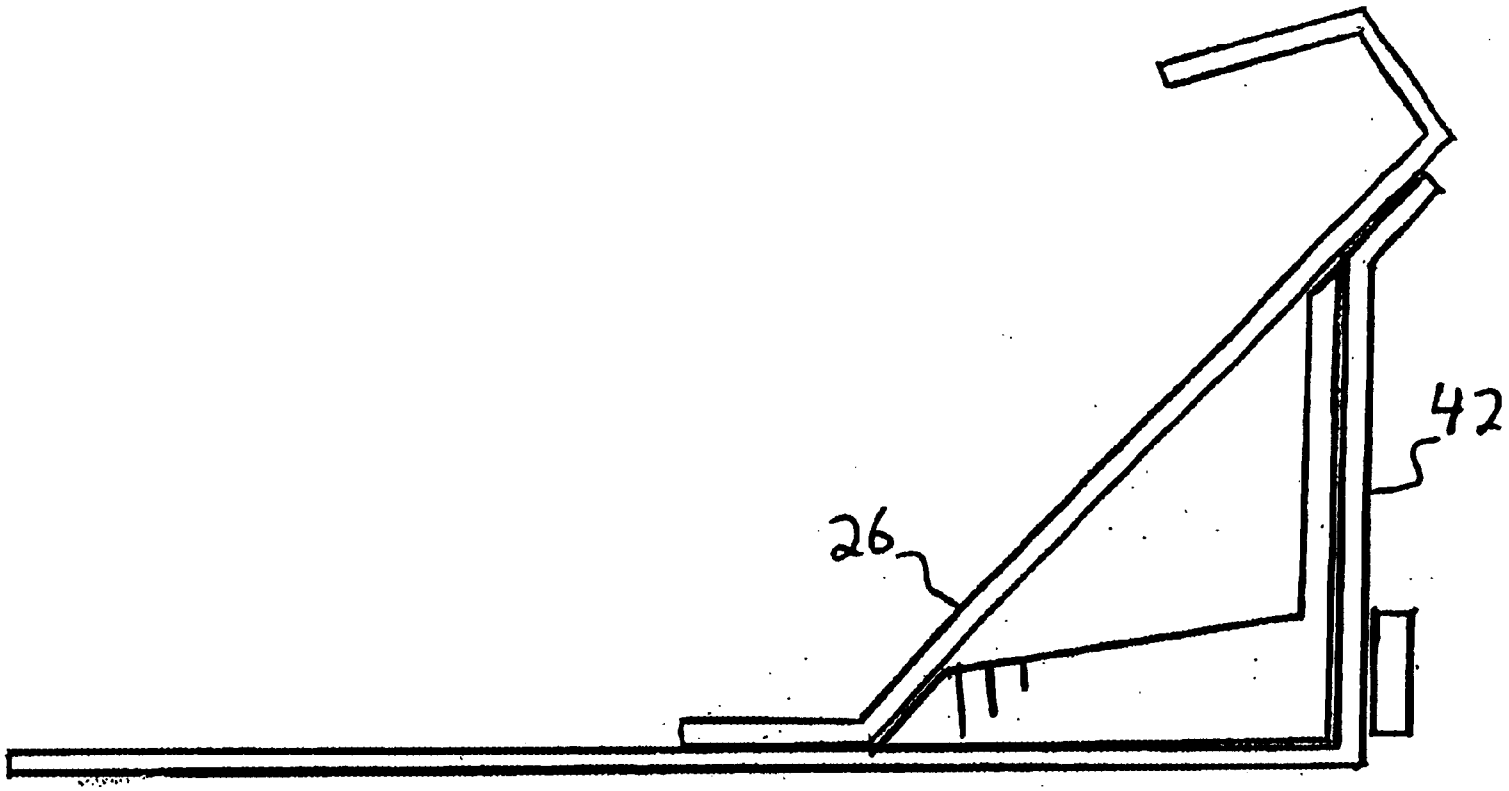
FIG. 16 is a side elevation view of a roofing bracket wherein the backside support extends directly upward to a point of attachment with the platform support.

It should be noted that several other embodiments of various aspects of the roofing bracket 10 are also suitable to give effect to the present invention. For instance, FIG. 14 shows a roofing bracket 10 wherein the guardrail 38 extends directly from the backside support 42. Also, it is not necessary for the backside support 42 to be perpendicular to the base 12. As shown in FIG. 15, the backside support 42 angles inwardly directly from the base 12. Finally, the backside support 42 can be configured a number of additional ways. For instance, as shown in FIG. 16, the backside support 42 extends directly upward to be attached to the platform support 26.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention as defined in the appended claims.

What is claimed is:

1. A roofing bracket for use with a platform, said bracket including:

a base having a proximal and a distal end and at least one nail slot disposed therethrough towards the distal end of said base;

a platform support arm having a bottom lip superpositioned over and attached to the base, further having a platform support extending from said bottom lip, said platform support including an upper end;

a guardrail positioned off the upper end of said platform support;

a backside support extending from the proximal end of the base, said backside support being attached with a rear portion of said platform support, said backside support further including a maximum height measured from the base to a point of intersection with platform support arm; and at least one brace extending from the backside support toward the platform support arm, said brace having a maximum height that is less than one half of the maximum height of said backside support.

2. The roofing bracket of claim 1, further including a heel extending rearwardly from said backside support.

3. The roofing bracket of claim 1, wherein said at least one brace includes a back surface contiguous with a front surface of said backside support and a bottom surface contiguous with an upper surface of said base.

4. The roofing bracket of claim 1, wherein said at least one brace includes a back surface contiguous with a front surface of said backside support and a frontward surface contiguous with a rear surface of said platform support.

5. The roofing bracket of claim 1, wherein said at least one brace includes a back surface contiguous with a front surface of said backside support, a bottom surface contiguous with an upper surface of said base and a frontward surface contiguous with a rear surface of said platform support.

6. The roofing bracket of claim 1, wherein said at least one brace includes a corrugation along said base extending from said backside support.

7. The roofing bracket of claim 6, wherein said corrugation extends from said backside support substantially to said platform support.

8. The roofing bracket of claim 1, wherein said at least one brace is one piece and includes a first rectangular portion connected to the backside support and a second wedge shaped portion connected to the platform support.

9. The roofing bracket of claim 1, wherein said at least one brace is one piece and includes a first rectangular portion connected to the backside support and a second triangular shaped portion connected to the platform support.

10. A roofing bracket for use with a platform, said bracket including:

a base having a top surface, a proximal and a distal end and at least one nail slot disposed therethrough towards the distal end of said base;

a platform support arm having a bottom lip superpositioned over and attached to the base, further having a platform support extending from said bottom lip, said platform support including an upper end and a rear surface;

a guardrail extending from the upper end of said platform support;

a backside support including a frontside and a backside, said backside support extending from the proximal end of the base, said backside support being attached with a rear portion of said platform support, said backside support further including a maximum height measured from the base to a point of intersection with said platform support arm;

at least one brace extending from the backside support toward the platform support arm, said brace having a maximum height that is less than one half of the maximum height of said backside support; and a heel extending from the rear of said backside support.

11. The roofing bracket of claim 10 wherein said at least one brace includes a back surface contiguous with a front surface of said backside support and a bottom surface contiguous with an upper surface of said base.

12. The roofing bracket of claim 10, wherein said at least one brace includes a back surface contiguous with a front surface of said backside support and a frontward surface contiguous with a rear surface of said platform support.

13. The roofing bracket of claim 10, wherein said at least one brace includes a back surface contiguous with a front surface of said backside support, a bottom surface contiguous with an upper surface of said base and a frontward surface contiguous with a rear surface of said platform support.

14. The roofing bracket of claim 10, wherein said at least one brace includes a corrugation along said base extending from said backside support.

15. The roofing bracket of claim 14, wherein said corrugation extends from said backside support substantially to said platform support.

16. The roofing bracket of claim 10, wherein said heel is rectangular shaped.

17. The roofing bracket of claim 10, wherein said heel is disc shaped.

18. The roofing bracket of claim 10, wherein the backside of said heel is of a different color than the backside of said backside support.

19. The roofing bracket of claim 10, wherein said at least one brace is triangular shaped including a lower edge having a lower edge length and a backside edge having a backside edge length.

20. The roofing bracket of claim 19, wherein said lower edge extends from the front side of said backside support to the back side of said platform support.

21. The roofing bracket of claim 19, wherein said base includes a longitudinal center wherein said lower edge is disposed longitudinally along the longitudinal center of said base.

22. The roofing bracket of claim 10, wherein said base, said backside support, said heel and said at least one brace are cumulatively one piece cast.

23. The roofing bracket of claim 10, wherein said roofing bracket is one piece cast.

24. The roofing bracket of claim 10, including a plurality of parallel spaced braces.

25. The roofing bracket of claim 10, wherein the front side of said backside support, a portion of the rear surface of said platform support and the top surface of said base between the intersection of said base and said platform support and the intersection of said base and said backside support forms a triangular shaped volume having a thickness being the width of said base, and wherein said brace is the same shape and size as the triangular shape of the triangular shaped volume and disposed on the longitudinal axis of said base.

26. The roofing bracket of claim 10, wherein said at least one brace extends from the front side of said backside support to the rear surface of said platform support.

27. The roofing bracket of claim 10, wherein said at least one brace is rectangular shaped.

28. The roofing bracket of claim 10, wherein said at least one brace is one piece and includes a first rectangular portion connected to the backside support and a second wedge shaped portion connected to the platform support.

29. The roofing bracket of claim 10, wherein said at least one brace is one piece and includes a first rectangular portion connected to the backside support and a second triangular shaped portion connected to the platform support.

30. A method of fabricating a roofing bracket, said method comprising the steps of:

fabricating a first piece, wherein said first piece includes, a base having a proximal and a distal end and at least one nail slot disposed therethrough towards the distal end of said base, and a backside support extending from the proximal end of the base, said backside support having a frontside and a maximum height;

fabricating a second piece, wherein said second piece includes a platform support arm having a bottom lip which can be superpositioned over and attached to the base, further having a platform support extending from said bottom lip, said platform support including a rear surface and a front surface said platform support arm further having a guardrail extending from the platform support;

securing said first piece to said second piece, wherein said bottom lip is superpositioned over and attached to the base and said backside support is attached with a rear portion of said platform support, wherein at least a portion of the rear surface of said platform support and a portion of the front side of said backside support define a shaped volume;

fabricating at least one brace having dimensions that define a portion of said shaped volume, said at least one brace having a height that is less than one half of the maximum height of said backside support; and securing said brace to the backside of said platform support and to the front side of said backside support and to the top of said base.

31. The method of claim 30, further including the steps of fabricating a heel and securing said heel to the rear of said backside support.

32. The method of claim 30, wherein said securing said first piece to said second piece further includes the step of riveting the first piece to the second piece.

33. The method of claim 30, wherein said securing said first piece to said second piece further includes the step of welding said first piece to said second piece.

34. The method of claim 32, further including the step of welding said at least one brace to the backside of said platform support and to the front side of said backside support and to the top of said base.

35. The method of claim 33, further including the step of welding said at least one brace to the backside of said platform support and to the front side of said backside support and to the top of said base.

* * * * *